US005375885A

United States Patent [19]

Abercrombie

[11] Patent Number: 5,375,885

[45] Date of Patent: Dec. 27, 1994

[54] COMBINATION BOOKMARK AND PAGE PROP DEVICE

[76] Inventor: Robert N. Abercrombie, 14479 Willow Bend, Chesterfield, Mo. 63017

[21] Appl. No.: 235,452

[22] Filed: Apr. 29, 1994

[51] Int. Cl.[5] ..... B42D 9/00

[52] U.S. Cl. ..... 281/42; 281/45; 116/234

[58] Field of Search ..... 281/42, 45, 49, 51; 116/234, 236, 237; 248/441.1, 446, 447, 451

[56] References Cited

U.S. PATENT DOCUMENTS

| | | | |
|---|---|---|---|
| 761,556 | 5/1904 | Tack . | |
| 785,215 | 3/1905 | Hill . | |
| 922,110 | 5/1909 | Eberle . | |
| 1,207,396 | 12/1916 | Gordon . | |
| 2,244,613 | 3/1944 | Hellstern | 116/119 |
| 2,300,216 | 10/1944 | Grodsky et al. . | |
| 2,670,221 | 2/1954 | Wellendorf | 281/1 |
| 2,699,748 | 1/1955 | Crawford | 281/42 |
| 2,716,390 | 8/1955 | Goins . | |
| 3,016,036 | 1/1962 | Jorgensen | 281/42 |
| 3,513,806 | 5/1970 | Ferrick | 116/119 |
| 5,286,060 | 2/1994 | Rivera | 281/42 |

OTHER PUBLICATIONS

Levenger Catalog, Winter 1994 p. 35.

*Primary Examiner*—Willmon Fridie

*Attorney, Agent, or Firm*—Polster, Lieder, Woodruff & Lucchesi

[57] ABSTRACT

A combination bookmark and page prop device having a first elongated arm and a second elongated arm connected, end-to-end by a hinge. A space is created between the respective connected ends of the support arms so that rotation of the support arms in one direction about the hinge results in an abutting relationship between the arms creating a positive stop wherein the respective support arms are positioned at an angular relationship of approximately 80° to 100°. Each support arm is placed upon an opposed page of a bound document to prop it open. The respective support arms can be rotated about the hinge until they are fully extended, end-to-end, to function as a flat bookmark. The support arms can be further rotated about the hinge until the support arms are aligned parallel to one another to form a relatively flat bookmark approximately one-half the length of the fully extended marker. The support arms are constructed from a clear material to allow viewing of printed material through the arms. Each arm has a tacky coating on at least one exposed surface to prevent slipping when placed on pages.

11 Claims, 3 Drawing Sheets

COMBINATION BOOKMARK AND PAGE PROP DEVICE

BACKGROUND OF THE INVENTION

This invention relates to a stationery item, more particularly to a combination bookmark and page prop device.

Bookmarks are well known in the art. Generally, a bookmark is a flat, elongated piece of cardboard, paper, leather or like material used to insert between the pages of a book or other bound document to mark the reader's place between readings. Prior art or known bookmarks function well for that limited use. However, most bound documents that are commonly used do not remain in an open position on the desired page without the aid of a supporting object or objects, usually the readers hands or forearm. There are, therefore, occasions where it is beneficial not only to mark the reader's place at a specific point in the book between readings, but also to prop the pages open for viewing while a text is in use. For example, it is advantageous to prop open a cookbook to expose a certain recipe for reference while allowing the user full use of his or her hands in preparing the dish. A page prop is also useful for allowing a casual reader to relax and place a novel on a table or in his or her lap freeing the hands for other uses such as eating a snack or drinking beverage. Likewise, it is desirable to prop open a prayer book for access to a particular reading, or prop open a song book so that a singer or musician can view a particular song or piece of music. A page prop would be particularly useful in situations in which text must be exposed for reference or analysis, yet full use of the hands is necessary for the user in transcribing information, such as a student working on studies or an accountant performing an audit using bound computer reports or an account book. Finally, a page prop is of especially important use for those individuals that would not otherwise be able to enjoy reading due to arthritis or other afflictions that result in decreased dexterity.

As stated above, although traditional bookmarks function well to mark a particular spot in a book, they do not function to prop open pages for viewing. Moreover, the placement of a traditional bookmark generally obscures written material from the reader's view. Also, traditional bookmarks generally have slick surfaces and can be easily dislodged from the desired position between pages.

SUMMARY OF THE INVENTION

It is, therefore, an object of the present invention to provide a combination bookmark and page prop device that can function either as a book marker or as a page prop.

Another object of the invention is to provide a combination bookmark and page prop device having two elongated support arms connected, end-to-end, by a hinge means to allow rotation of the arms about the hinge between the prop configuration and the bookmark configuration.

It is another object of the present invention to provide a combination bookmark and page prop device that is constructed from a clear material to allow viewing of printed material through the device.

Still another object of the present invention is to provide a combination bookmark and page prop device having a non-slip coating on an external surface to secure the device in a proper_position and prevent slipping.

Yet another object of the present invention is to provide a combination bookmark and page prop device that is simple and economical to construct, easy to use, easy to store, and well suited for its intended purposes.

In accordance with the invention briefly stated, a combination bookmark and page prop device is provided having a first elongated arm and a second elongated arm. The respective arms are connected, end-to-end, by a hinge. A space is created between the respective connected ends of the arms so that rotation of the support arms in one direction opens the hinge approximately 260° to 280° until ends of the arms abut creating a positive stop. The support arms are thus positioned at an angular relationship of approximately 80° to 100° so that each support arm can be placed on an opposed page of a bound document to prop open the pages. The respective support arms can be rotated about the hinge until the hinge is opened 180° and the arms are fully extended, end-to-end, to function as a flat bookmark. The support arms can be further rotated until the hinge is closed and support arms are aligned parallel to form a relatively flat bookmark of approximately one-half the length of the fully extended mark. The support arms are constructed from a clear material to allow viewing of printed material through the arms. Each arm has a tacky coating on at least one exposed surface to prevent slipping when placed on pages.

DESCRIPTION OF THE PREFERRED EMBODIMENTS

Figure 1:
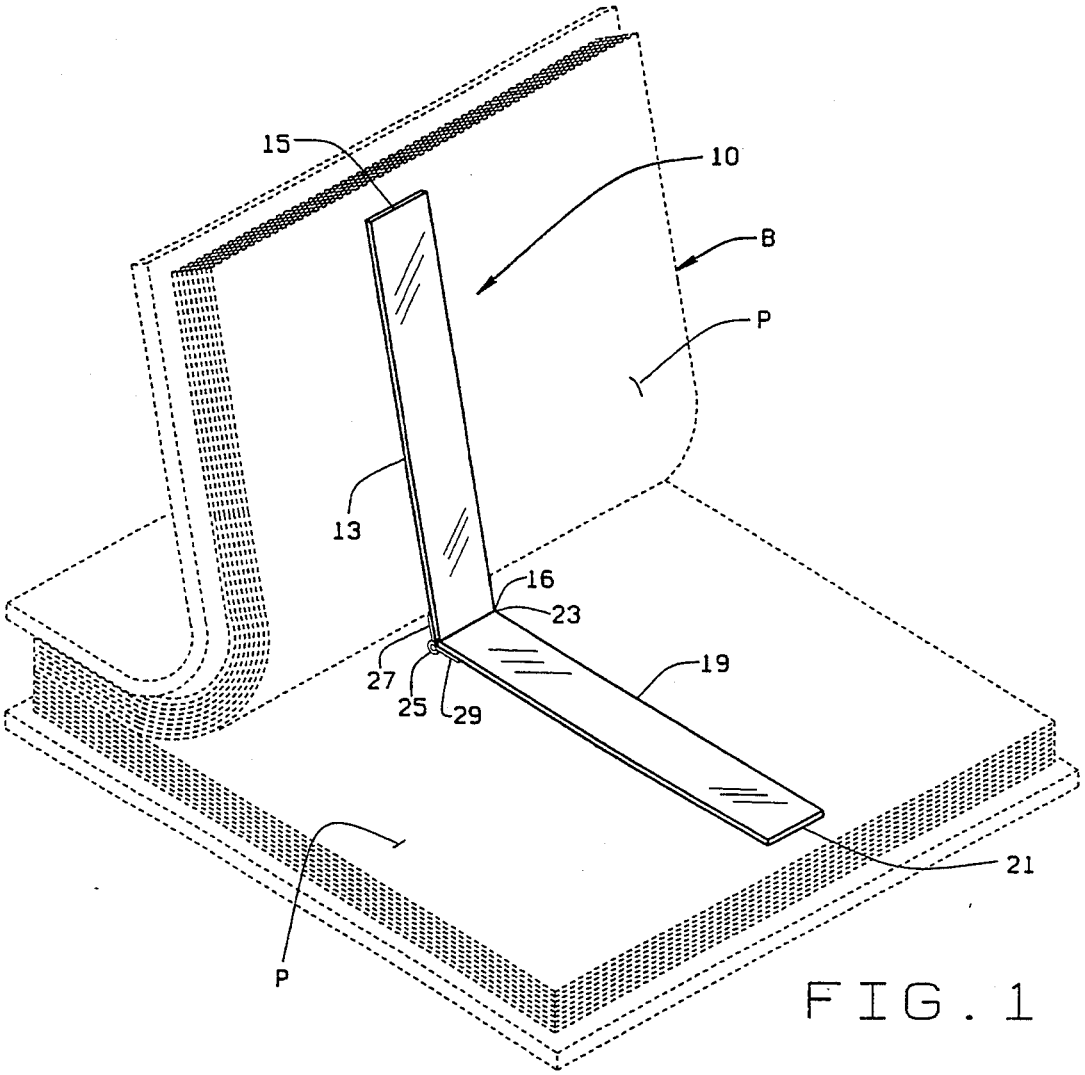
FIG. 1 is perspective view of the combination bookmark and page prop device in the prop configuration, placed between opposed pages of a book, shown in phantom to illustrate environment.
Figure 2:
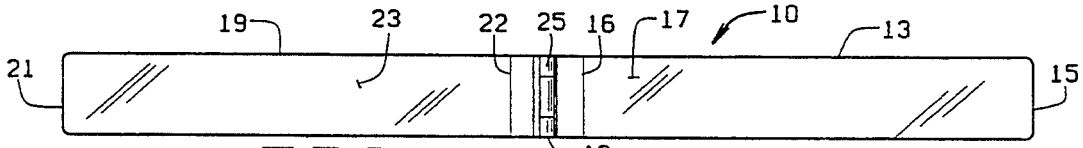
FIG. 2 is a top plan view of the combination bookmark and page prop device of the present invention.
Figure 3:
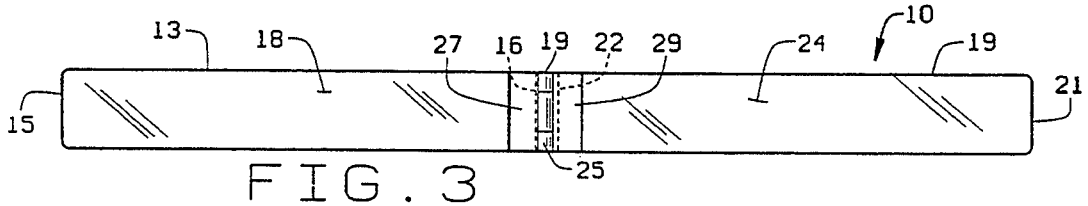
FIG. 3 is a bottom plan view of the combination bookmark and page prop device of the present invention.
Figure 4:
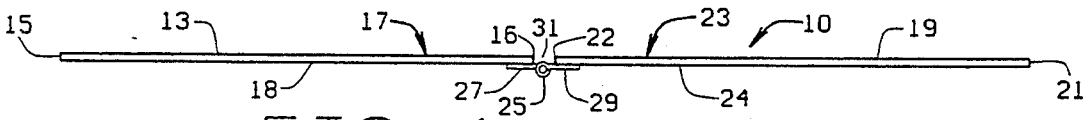
FIG. 4 ms a side elevational view thereof.

The combination bookmark and page prop device of the present invention has indicated generally in the various drawings by reference numeral 10.

Figure 7:
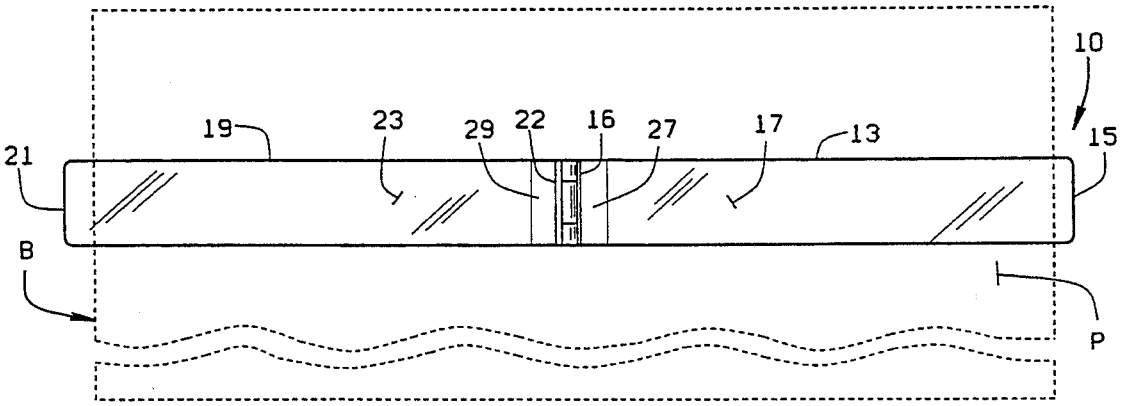
FIG. 7 is a top plan view thereof, the device shown placed upon a page, shown in phantom to illustrate environment.
Figure 8:
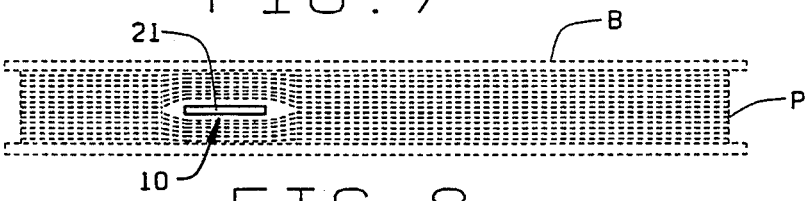
FIG. 8 is an end plan view thereof, the device inserted between pages in a book shown in phantom to illustrate environment.

As shown in FIG. 1, device 10 can be used to prop open the pages of a book B. Furthermore, as shown in Figures 7 and 8, device 10 can be fully extended to function as a marker between pages P to mark a reader's place in book B. The individual elements of device 10 will now be described in greater detail.

Device 10 has a first elongated support arm 13. Support arm 13 is a generally flat, elongated structure having a first or free end 15, a second end 16, a first elongated flat side surface 17 and a second elongated flat side surface 18. In the preferred embodiment, support arm 13 is constructed from a transparent or "see-through", resilient material such as a clear, high impact plastic, acrylic or the like, that allows the user to view a page P through support arm 13. Preferably, support arm 13 is less than 1/16th of an inch thick, yet resilient enough to support pages without bending or distorting. Flat side surface 18 of support arm 13 has a tacky coating to create a non-slip surface. The tacky coating can be made from a clear, siliconized acrylic latex or other appropriate material.

Device 10 has a second support arm 19 which is a mirror image of support arm 13. Support arm 19, constructed from the same transparent material and in the same thickness as arm 13, has a first or free end 21 and a second end 22 as well as a first, elongated flat side surface 23 and a second elongated flat side surface 24. Flat side surface 24 has a tacky, non-slip coating on the surface, formed from appropriate material such as clear, siliconized acrylic latex as previously described.

Support arms 13 and 19 are connected by a pivot point or hinge means 25. In the illustrated embodiment, hinge means 25 is a relatively flat conventional type hinge, constructed from metal or high impact plastic. Hinge 25 has a first leaf 27 attached to flat side surface 18 of support arm 13 adjacent end 16. Hinge 25 has a second leaf 29 attached to flat side surface 24 of support arm 19, adjacent end 22. Respective support arms 13 and 19 can be attached to the respective hinge leaves 27 and 29 by gluing, riveting, or other appropriate attachment means. It should be noted that hinge 25 can be integrally formed from the support arms and not a separate hinge, as shown. The respective support arms 13 and 19 are positioned, slightly asymmetrically on the respective hinge leaves so as to create a space 31 between ends 17 and 22 to permit limited folding of the device about the hinge means in one direction, as will now be explained.

Figure 6A:
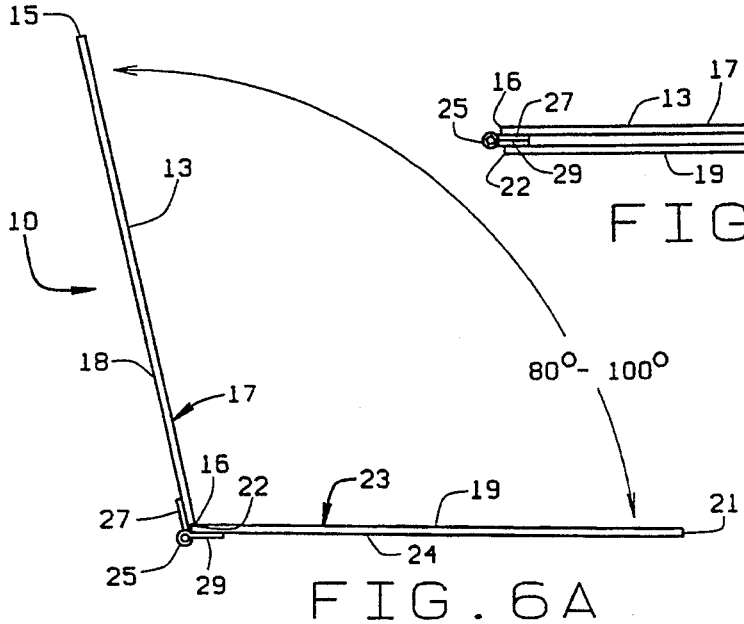
FIG. 6A is a side elevational view thereof, the support arms rotated to a prop configuration.
Figure 6B:
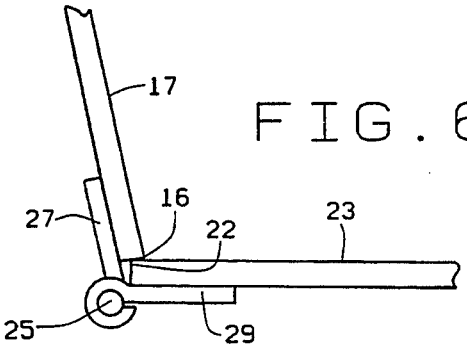
FIG. 6B is an enlarged, partial view of the hinge area.

As shown in FIGS. 6A and 6B, the respective support arms 13 and 19 can be rotated about hinge 25 toward each other until end 16 abuts flat surface 23 adjacent end 22. The hinge opens approximately 260° to 280° . This abutment creates a positive stop to prevent further movement of support arms 13 and 19 toward each other and results in an angle of approximately 80° to 100° between the respective support arms. In this position, device 10 is used to prop open pages P as illustrated in FIG. 1. Flat side surface 18 engages one page and flat side surface 24 engages the opposite page. The tacky material prevents slipping.

Figure 5:
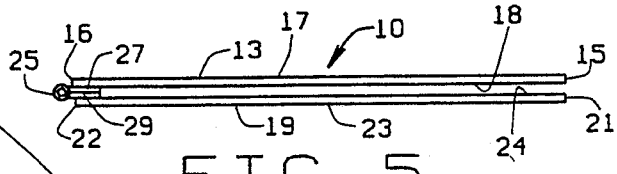
FIG. 5 is a side elevational view thereof, the support arms rotated to an adjacent position.

As illustrated in FIG. 5, the respective support arms 13 and 19 can be rotated about hinge 25 until the hinge closes and flat side surface 18 and 24 are parallel. Hinge wing 27 abuts hinge wing 29 and the respective ends 21 and 23 are adjacent each other. In this position, device 10 can be carried in a pocket or stored, for example, in a briefcase or the like. The adjacent alignment of the support arm creates a bookmark of approximately one-half the overall length of the fully extended mark.

As illustrated in FIGS. 7, the respective support arms 13 and 19 can be rotated about hinge 25 until the hinge is opened 180° and support arms 19 and 13 are axially aligned or "end-to-end". In this configuration, device 10 is at its maximum length and is relatively flat. The respective flat side surfaces 18 and 24, with tacky material thereon, engage page P of an open book B to mark a line as a reader progresses. As shown in FIG. 8, device 10, can be placed between pages P with book B closed to function as a bookmark.

Figure 9A:
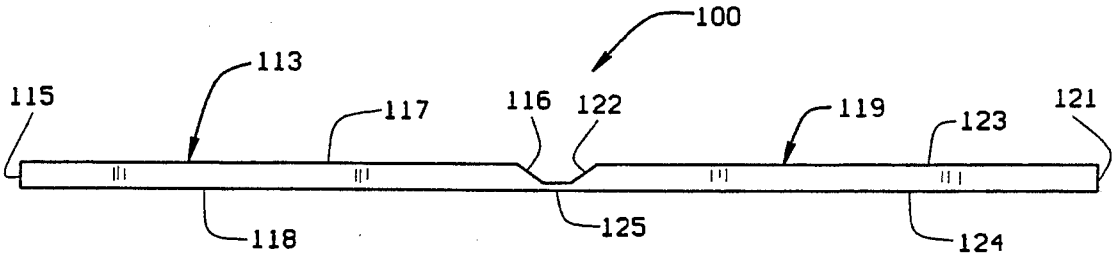
FIG. 9A is a side elevational view of an alternative embodiment of a combination bookmark and page prop in the bookmark configuration.
Figure 9B:
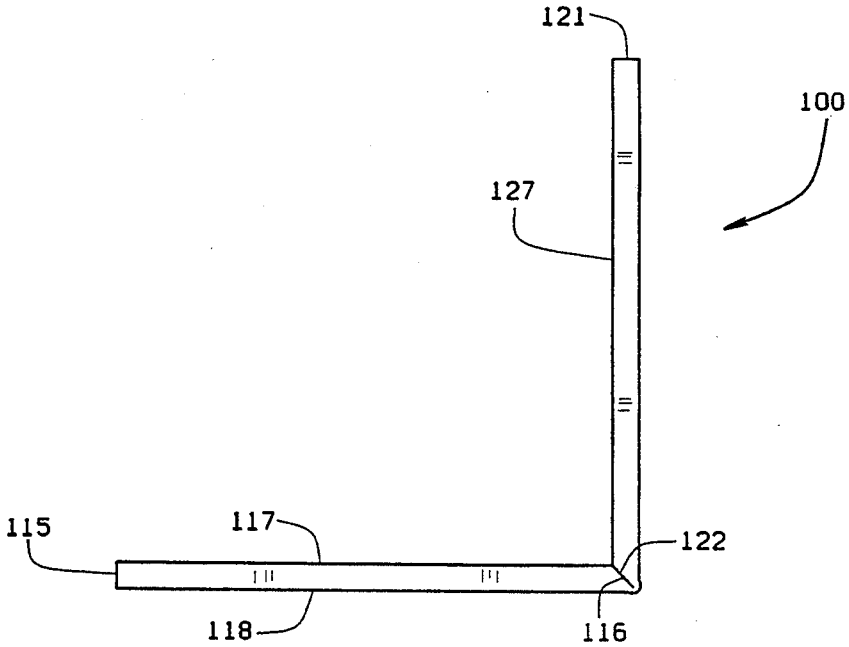
FIG. 9B as a side elevational view thereof in the page prop configuration.

FIGS. 9A and 9B show a representative, alternative embodiment of the bookmark and page prop device of the present invention, indicated generally by reference numeral 100. Device 100 has a first elongated support arm 113. Support arm 113 is generally flat, elongated structure having a first or free end 115 and a second beveled end 116, a first elongated flat side surface 117 and a second elongated flat surface 118. Support arm 113 can be constructed from a transparent resilient material, as previously described. Flat side 118 surface has a tacky coating, also as previously described.

Device 100 has a second support arm 119 which is a mirror image of support arm 113. Support arm 119 is constructed from the same material and in the same thickness as support arm 113. Support arm 119 has a first or free end 121, a second beveled end 122, as well as a first, elongated flat surface 123 and a second elongated flat side surface 124. Flat side surface 124 has a tacky, non-slip coating on the surface, formed from an appropriate material such as a clear or siliconized acrylic latex as previously described.

Support arms 113 and 119 are connected by a pivot point structure or hinge means 125, formed from a flexible material between the respective flat surfaces 118 and 124. Hinge means 125 can be a separate flexible material appropriately attached to the respective surfaces or can be a thin, flexible, contiguous segment of the respective support arms. As shown in FIGS. 9A and 9B, respective support arms 113 and 119 can be rotated about the hinge 125 toward each other until beveled end 116 abuts beveled end 122. This abutment creates a positive stop to prevent further movement of support arms 113 and 119 toward each other and results in an angle of approximately 90° between the respective support arms. In this position device 100 is used to prop open the pages of a book in the same manner as described relative to device 10. The respective support arms 113 and 119 can be rotated about hinge 125 until the support arms 119 and 113 are axially aligned or "end-to-end" in the configuration, shown in FIG. 9A, where device 100 is at its maximum length and is relatively flat. Furthermore, the respective support arms 113 and 119 can be rotated about hinge 125 until the flat sides surface 118 and 124 are parallel (not shown). In this position device 100 can be conveniently carried in a pocket or stored for example, in a brief case or the like. The adjacent alignment of the support arms creates a bookmark of approximately one-half of the overall length of the fully extended mark as shown in FIG. 9A.

It will be understood that various changes and modifications can be made in the device without departing from the scope of the appended claims. For example, the overall dimensions of devices 10 and 100 can vary according to their intended use. The respective support arms can be constructed as long or as short as necessary. Furthermore, any acceptable hinge means may be used in place of hinges 25 or 125. The materials may vary without departing from the scope of the invention. Therefore, the foregoing description and accompanying drawings are intended to be illustrative only and should not be viewed in a limiting sense.

I claim:

1. A combination bookmark and prop device comprising:

a first elongated support arm;

a second elongated support arm;

said support arms having a tacky, non-slip material applied to at least one side;

hinge means connecting said first elongated support arm to said second elongated support arm; and said first and second elongated support arms being configured, arranged and positioned relative to said hinge means to enable said first and second elongated support arms to form a bookmark in at least one position and a prop device in a second position.

2. The bookmark and prop device of claim 1 wherein said support arms are rotatable about said hinge means.

3. The bookmark and prop device of claim 1 wherein each said support arm is flat.

4. The bookmark and prop device of claim 2 wherein said support arms can be rotated about said hinge means to be aligned parallel.

5. The bookmark and prop device of claim 2 wherein said support arms can be rotated about said hinge means to be axially aligned.

6. The bookmark and prop device of claim 2 wherein said support arms can be rotated about said hinge means to enable an end of one support arm to engage a side surface of the other support arm in abutting relationship to each other.

7. The bookmark and prop device of claim 1 wherein said support arms are transparent so as to allow a user to view through said support arm.

8. A combination bookmark and prop device comprising:

a first flat elongated support arm;

a second flat elongated support arm;

each said support arm having a tacky, non-slip material applied to at least one flat surface;

a hinge connecting said first support arm to said second support arm to allow rotation of said support arms about said hinge, relative each other, between a bookmark configuration where the support arms are in a flat condition and a book prop configuration where the support arms engage one another along adjacent end surfaces.

9. The device of claim 8 wherein said support arms are constructed from a clear, resilient material.

10. The device of claim 8 wherein said hinge can be opened from approximately 0° to approximately 260° to 280°.

11. The device of claim 8 wherein said material is a clear, siliconized acrylic latex.

* * * * *